United States Patent [19]

Holbert

[11] Patent Number: 4,905,843

[45] Date of Patent: Mar. 6, 1990

[54] VENEER STACKING SYSTEM

[75] Inventor: John C. Holbert, Corvallis, Oreg.

[73] Assignee: U.S. Natural Resources, Inc., Vancouver, Wash.

[21] Appl. No.: 178,478

[22] Filed: Apr. 7, 1988

[51] Int. Cl.[4] ..... B07C 5/344

[52] U.S. Cl. ..... 209/571; 209/539; 209/653; 209/905; 271/197; 198/394; 414/788.8

[58] Field of Search ..... 271/196, 197, 202, 203; 414/73, 72, 75, 69, 788.8; 209/539, 571, 651–654, 905, 933; 60/580, 581, 567, 562; 198/394

[56] References Cited

U.S. PATENT DOCUMENTS

| | | | |
|---|---|---|---|
| 2,499,563 | 3/1950 | Bill | 60/580 |
| 3,227,275 | 1/1966 | Cody | 209/933 |
| 3,480,160 | 11/1969 | Barradell-Smith et al. | 414/793.1 |
| 3,583,562 | 6/1971 | Yock et al. | 209/905 |
| 3,812,964 | 5/1974 | Woodruff | 209/571 |
| 4,511,242 | 4/1985 | Ashbee et al. | 198/394 |

*Primary Examiner*—Kevin P. Shaver
*Assistant Examiner*—Steven M. Rein
*Attorney, Agent, or Firm*—Robert L. Harrington

[57] ABSTRACT

A veneer stacking system providing the feature of consistent air suction above the multiple veneer stacks enabling reliable separation of the veneer sheets from an overhead conveyor. This consistent air suction is provided by independent air chambers for each stack. It also includes aligning belts for aligning the sheets on the overhead conveyor. An aligning belt replaces a section of one or both of the conveyor belts and is independently driven to speed up or slow down one side of the sheet to achieve the desired alignment. It also includes improved knock-off shoes activated byh cylinders connected to master cylinders in a master cylinder housing activated by a common mover piston for simultaneous knock off of veneer sheets onto the stacks.

7 Claims, 3 Drawing Sheets

VENEER STACKING SYSTEM

FIELD OF INVENTION

This invention relates to a veneer stacking operation and method, and more particularly to improvements that enable individual veneer sheets to be aligned in stacks for damage-free handling.

BACKGROUND OF THE INVENTION

Plywood production involves the peeling of a thin continuous layer of veneer from a log, e.g. 0.1 inch thick. The veneer as peeled is a continuous ribbon that is 101 inches wide. It is cut into individual sheets of varying sizes but for the purpose of this invention, the pertinent sizes are half sheets, e.g. 101 inches by 27 inches, and full sheets, e.g. 101 inches by 54 inches. The individual sheets are typically analyzed and stacked by a stacker according to size, grade and moisture content. The sheets are subsequently unstacked, dried and re-stacked, again by a stacker according to size, grade and moisture content. The acceptable sheets are then made into plywood consisting of laminated sheets of veneer.

It is to be particularly noted that two stacking operations are involved. One is referred to as the stacking of green veneer sheets and the other as the stacking of dried veneer sheets. Whereas there are differences as between the two stacking operations, the improvements provided by the present invention are equally applicable to both of these stacking operations. Hereafter all references to "stacking" unless specifically identified otherwise, has reference to both green and dry veneer stacking operations.

The sheets when distributed to the stacker are separated into designated stacks. For example, one stack may be designated for half sheets having a low moisture content, one for half sheets having a high moisture content, and one stack for moderate or acceptable moisture content. Similar designations of stacks are provided for the full sheets. Other designations are also quite common, e.g. according to grade.

The stacking operation is automatic or in some instances semi-automatic and, as contemplated herein, includes an in-feeding conveyor belt that conveys the individual sheets in sequence to an automatic stacking apparatus. The sheets are analyzed for size, moisture content and grade and then transferred from the incoming conveyor, on which the sheets are bottom supported, to the stacking conveyor, (a plurality of overhead belts) on which the sheets are top supported.

As concerns the overhead or stacking conveyor, air is drawn upwardly through the belts of the conveyor and the suction thus created adheres or attaches the sheets to the overlying surface of the belt. The belt conveys the sheets along the path over the stacking bins which are designated for sheets of specific size and range of moisture content (and where applicable by grade). Knock-off shoes positioned over the conveyor and in line with the bins are activated to dislodge or detach the sheets from the conveyor and deposit them on the stacks in the bins.

The primary consideration of this invention is to deposit the sheets uniformly on the stacks. In particular, the leading edge of the sheet must be carefully deposited to line up with the leading edge of the stack. A number of factors effect this alignment.

If the sheets aren't properly aligned on the overhead belt, they cannot be properly aligned on the stack. Thus the sheets must be properly aligned on the overhead belts.

If the air suction is greater for one sheet than another, i.e. if the suction is not consistent, successive sheets may be released differently and cause misalignment. Thus consistent air suction is desirable.

The left and right or front and back cylinders of the knock-off mechanism can be slightly out of sync and this can cause skewing. Thus the knock-off mechanism needs to be synchronized.

The different weights of the sheets due to moisture variation can change the forward momentum of the sheets as they are transferred to the stack. Thus sheets having different moisture content must be knocked off the conveyor at different positions in order to achieve the desired line up of all the differently weighted sheets within the stack.

All of these problems, in accumulation, typically provide significant misalignment of the sheets in the stack of sheets. Subsequent handling as when a forklift engages the stack, often damages the protruding edge of the misaligned sheets at a very substantial cost to the producer.

BRIEF DESCRIPTION OF THE INVENTION

One of the features being improved relates to the manner of providing air suction to the overhead conveyor. In prior stacking apparatus, a single air chamber and air source served the entire length of travel of the overhead conveyor as the sheets were moved along the pathway over the stacking bins. The presence or absence of veneer sheets across the air vents between the belts changes the negative air pressure within the air chamber. The pick up and deposit of numerous sheets into a plurality of bins, all being under the influence of a single air suction source, generates a wide variety of air vent inhibiting conditions.

In order to obtain the desired suction when the belt conveys but a single sheet, i.e. with the opening through the belts essentially unrestricted, the suction force has to be sufficient to draw that single sheet to the belt. As more sheets are deposited on the belt, this same suction becomes excessive and the force required by the knock-off shoes to remove the sheets can damage the sheets as well as affect accuracy of the dislodging function.

In the present invention, the length of travel of the conveyor is divided into multiple chambers with the sheets carried by the overhead conveyor being passed from air chamber to air chamber. Preferably a separate air chamber is provided over each of the bins. Thus the pressure of any one chamber can be maintained at a just-sufficient level to adhere a single sheet to the belt but over a substantially reduced area, which is low enough to avoid damage resulting from dislodging by the knock-off shoes.

A second feature being improved relates to sheet alignment on the conveyor belts. As explained, alignment of the sheets on the overhead belts is important and the action of the knock-off shoes must be coordinated in order to insure that the sheets will be cleanly separated from the belts and precisely aligned on the stacks.

In the present invention, the orientation of the sheets on the incoming conveyor are sensed and upon entering the vacuum zone, a repositioning apparatus consisting of overhead adjusting belts operates to adjust the orientation of the sheets prior to being transferred to the main conveyor for distribution of the sheets to the bins.

A third feature being improved relates to the action of the knock-off shoes. The knock-off shoes are typically activated by hydraulic or pneumatic (fluid) cylinders. There are two elongated shoes positioned above the sheet at the sides of the overhead conveyor belts and thus above the corresponding side edges of the sheets. Each shoe is activated by a pair of cylinders, i.e. a front and a rear cylinder. Thus there are four "shoe" cylinders that cooperatively act to dislodge the sheet from the conveyor.

The action of the two shoes must be precise and equal in order to cleanly dislodge the sheet at the point where the momentum of the sheet will result in the sheet being deposited, in alignment, onto the stack. Previously such precision was difficult to achieve, particularly in view of the changing vacuum pressure applied to the sheets and the variable operation rates of the valves and cylinders. Contributing to the problem was the practice of activating the rear cylinders (adjacent the leading edge of the sheet) ahead of the front cylinders (at the trailing edge) to effect a peeling action and thereby counter the high vacuum pressure.

In the present invention, the vacuum is consistent and substantially reduced, i.e. it is not excessive. Thus peeling is not required and the front and rear cylinders can be activated simultaneously. Precise simultaneous activation is provided by four master hydraulic cylinders that initiate action of each of the four shoe cylinders. The master cylinders are activated by a common pneumatic piston and equal liquid displacement as between each master cylinder and its connected shoe cylinder produces assured simultaneous action.

The above improvements, providing multiple air chambers for the overhead belt, aligning the sheets on the conveyor, and simultaneous action of the knock-off shoes, cooperate to achieve the desired "squared up" stacks of veneer sheets.

These improvements will be more clearly understood and appreciated by reference to the detailed description and the drawings referred to therein as follows.

Figure 2:
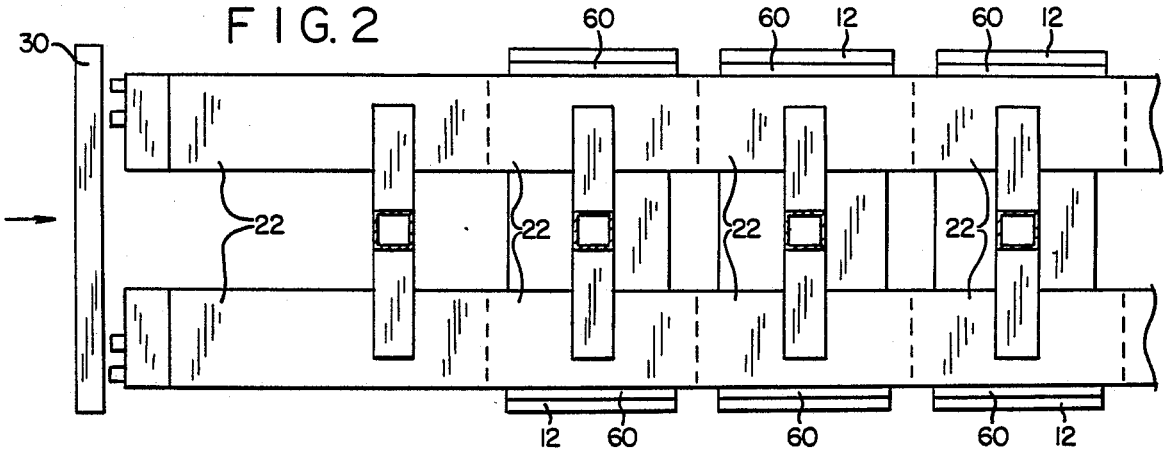
FIG. 2 is a view of the system as taken on view lines 2—2 of FIG. 1.
Figure 1:
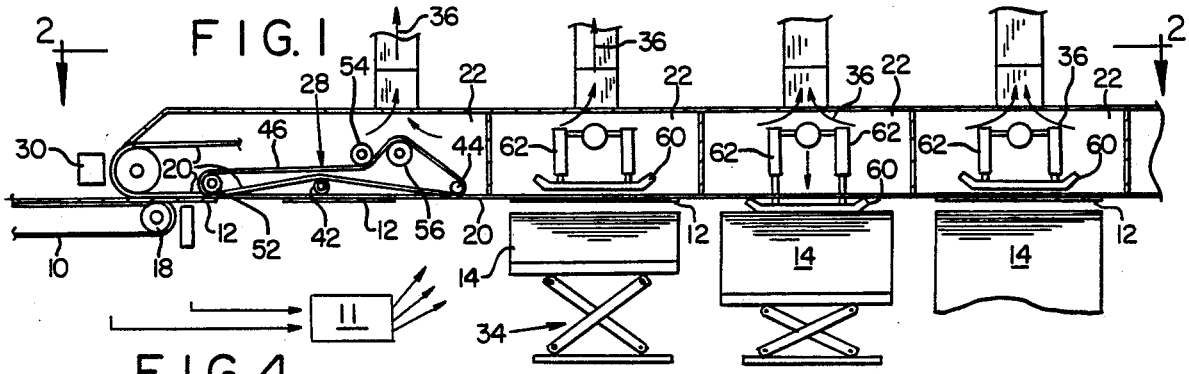
FIG. 1 is a schematic side view of a veneer stacking system incorporating the features of the present invention.

Reference is made to FIGS. 1 and 2. Illustrated is a conveyor belt 10 that conveys, in sequence, the veneer sheets 12 that have been clipped in a prior operation to the desired size. Whereas many different sizes of partial sheets result from this clipping operation, only the full sheets and half sheets are directed to the stacking operation. Both half and full sheets are oriented or positioned with the longer dimension, i.e. the 8' plus side as the lateral or leading edge. The depth or length of the sheets as determined by the path of travel is either 4' for full sheets or 2' for half sheets. The bins in which the half and full sheets are deposited are interchangeable and thus except for the designation process and the point of release, the invention herein is applicable to both the half and full sheets (and as previously explained, for stacking either green or dry veneer sheets).

In the prior clipping operation, the sheets have been cut to the same dimensions if full sheets and to the same dimensions if half sheets, e.g. 101"×54" or 101"×27". The object of the stacking operation is to categorize the full and half sheets by size, moisture content (and grade, if applicable) and then stack the sheets accordingly, as illustrated by the stacks 14. Only three stacks are shown but typically there are six or more as determined by the need of any particular stacking operation. These stacks are segregated into stacking bins the structure of which is eliminated for clarity.

The veneer sheets are fragile, being only about 0.1 inch thick and this stacking operation and the subsequent handling of the sheets must be done with care so as not to damage the sheets. Yet speed is of utmost importance as well. To damage even a small percent of the sheets during the stacking and stack-handling operations is very costly. A damaged sheet in a stack of sheets can be passed all the way to the point where it is laid up in a sheet of plywood (including a number of laminated sheets of veneer). The entire plywood sheet, being defective is then designated as waste. Hundreds of thousands of dollars can be lost to a plywood mill in this manner. Automatic machinery for delicately and speedily accomplishing these operations is worth substantial investment in stacking and stack-handling improvements.

Stack-handling is not a part of the present inventions except to recognize that the achievement of squared-up stacks is considered essential to enable damage-free stack handling. That is, the veneer sheets are desirably stacked one on top of another exactly in line so that corners and edges do not project out from the stack. Such projected edges and corners are a common cause of damage in the subsequent stack-handling operation.

Each of the stacks 14 are supported on conventional adjusting scissors-type stack holders 34. The adjustment feature maintains the top of the stack in close proximity to the knock-off shoes to be explained in a late section. The stack unloading apparatus is also conventional to existing stackers and is not illustrated. The inventive features all reside within that part of the system wherein the sheets 12 are transferred from the conveyor 10 to the stacking apparatus and the handling of those sheets up to the point of depositing the sheets 12 onto the stacks 14.

Figure 4:
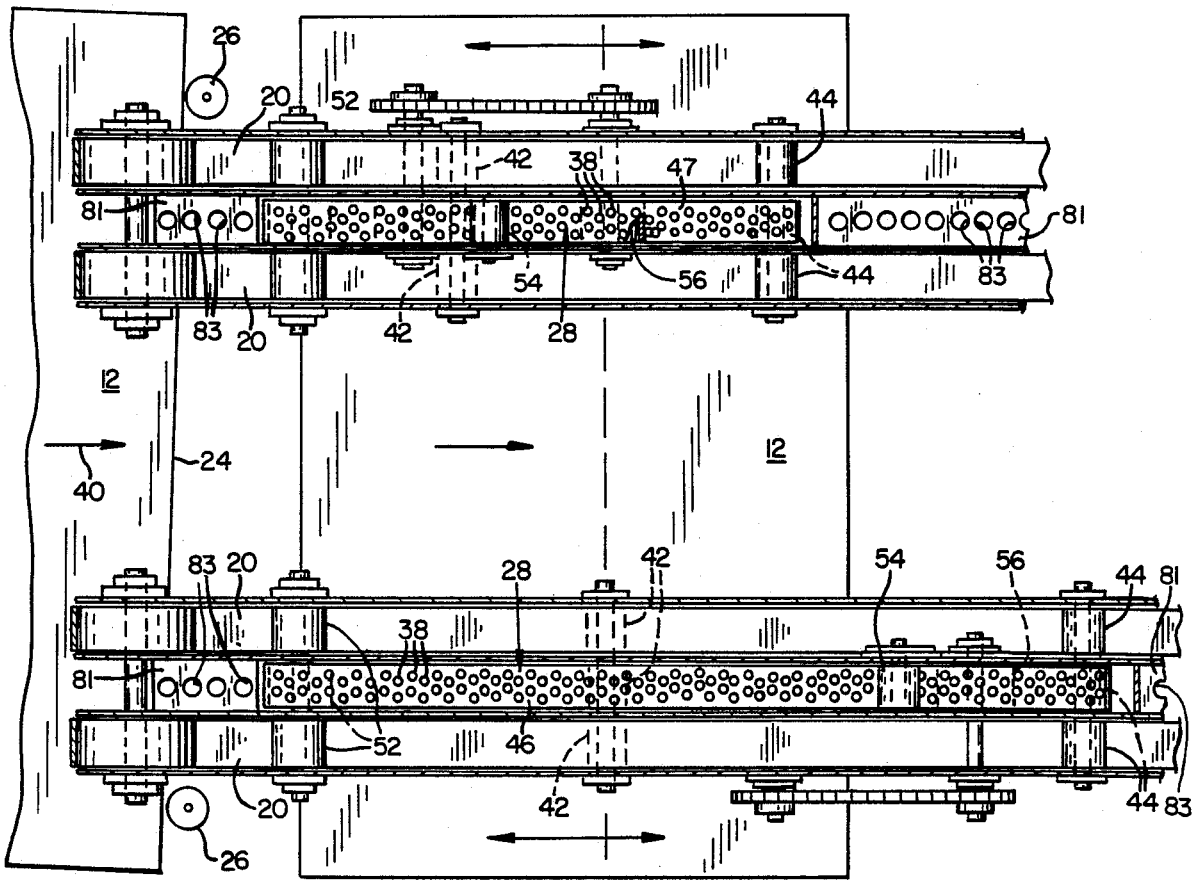
FIG. 4 is a section view as indicated by view lines 4—4 of FIG. 3.
Figure 3:
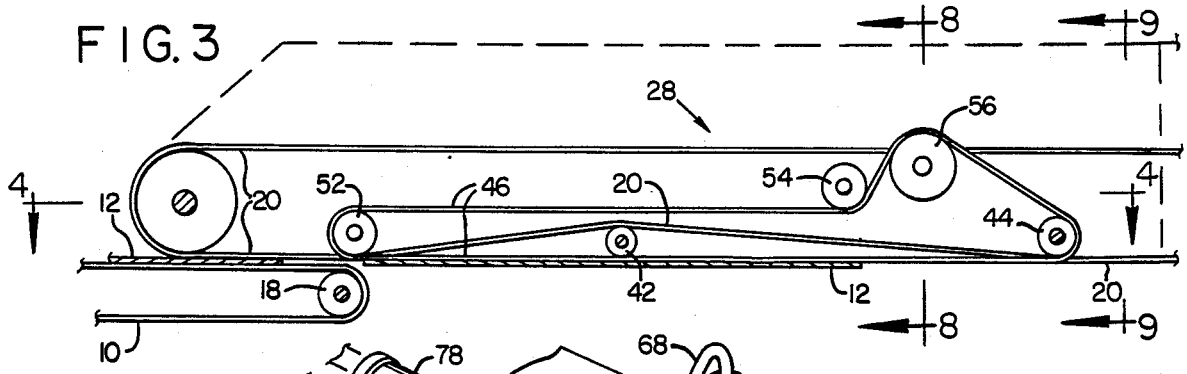
FIG. 3 illustrates the sheet aligning mechanism of the system of FIGS. 1 and 2.

Referring now also to FIGS. 3 and 4, as explained the sheets 12 are transferred from a conventional bottom supporting belt conveyor 10 to the stacker conveyor which is a top supporting overhead conveyor 20 (consisting of multiple conveyor belts which will be referred to as conveyor belts 20). Just prior to this transfer, however, the moisture content of the sheet is detected by detector 30. Although important for achieving stack designation, such detectors are well-known and will not be specifically described herein.

The overhead conveyor is enveloped in a housing consisting of a plurality of air chambers 22. The first of these chambers 22 is the set-up chamber. Three functions are accomplished within the space of this first chamber. The sheets 12 are transferred from the conveyor 10 to the overhead conveyor 20 as indicated in FIG. 1. The leading edge 24 of the sheet 12 is then sensed adjacent the corners, by optical scanners 26. These scanners will detect the edge 24 simultaneously if the sheet 12 is properly aligned on the belt.

If the sheet is misaligned, the extent of misalignment will be determined by a pulse generating device. If the trailing side of the sheet is detected at five pulses after the leading side, the trailing side must be accelerated to make up this differential. Such pulse generating devices are well known and will not be further explained. (It will here be explained that all of the functions, computations and controls are provided by a computer 11 illustrated in FIG. 1 with input and output directional arrows. The use of a computer for coordinating the functions herein described is also well known in the art and explanation of the computer and its application within the system is not provided.)

The next operation of the system taking place within the first or set-up chamber 22 is the realignment of any misaligned sheet 12. This is accomplished by the mechanism at each side of the conveyor 20 generally indicated by reference 28. This alignment mechanism will be more specifically described in a following section.

Whereas the veneer sheets are typically conveyed into the stacker in orderly succession one after the other, the area covered by the sheets 12 within the first chamber 22 is substantially consistent. Because the sheets are not being knocked off the conveyor within this first chamber, a changing vacuum pressure does not create the problem as occurs over the plurality of stacks 14 on which the sheets are deposited.

Once the sheets have been categorized by moisture content, size and grade (if applicable), and then aligned on the overhead belts 20, they are ready to be deposited on the appropriate stack 14. As shown in FIG. 1 particularly, the sheets 12 are conveyed by overhead conveyor 20 through the plurality of air chambers 22. Each of these successive air chambers following the set-up chamber, is associated with a pair of knock-off shoes 60 that is aligned over each of the stacks 14.

As is typical for stackers in general, the sheets 12 are adhered to the overhead conveyor or belts 20 by air. The belts 20 are provided in pairs as illustrated in FIG. 4 and air is drawn between the belts and exhausted from the chambers 22 through a conduit connected to a vacuum source, indicated by arrows 36 (FIG. 1). More specifically, as particularly seen in FIG. 4, a pair of belts 20 are provided on each side of the stacker at either side of the conveyed sheets. The chambers 22 are split into left and right sub-chambers (as viewed when facing along arrow 40) that envelop the two pairs of belts. Each pair of sub-chambers merge into one chamber with a single overhead exhaust (again arrows 36).

Each of the paired sub-chambers 22 are independently served by a negative air source. Thus the vacuum force that is generated is controlled to accommodate the effect of the presence or absence of but one sheet in that chamber. This concept of separating the housing into independent chambers is considered a major factor in accomplishing the desired "squared-up" stacking of the veneer sheets in the improved system described herein. The "squared-up" stacking in turn significantly reduces damage and dramatic savings to the mill operation.

THE ALIGNMENT MECHANISM

Reference is now made to FIGS. 3 and 4 which illustrate the concept of the alignment mechanism. As previously explained with reference to FIG. 1, the sheets 12 which are transferred from conveyor 10 to conveyor 20 may not be properly aligned. What this means is that the leading edge 24 of the sheet 12 is not perpendicular to the path of travel indicated by arrow 40 (FIG. 4). The sheet 12 will thus be skewed on the conveyor and one side of edge 24 will be leading the other side of edge 24. When this happens, the sensors or scanners 26 will detect the extent of the skew and the computer will compute the need for adjustment. For example, considering the relative positions of the two pairs of belts 20, the computer can determine that one of the pairs needs to advance or retract some determined distance relative to the other belt in order to draw the sheet 12 into a squared-up position on the conveyor (with leading edge 24 perpendicular to path 40). Of course, conveyor 20 is controlling the movement of a plurality of sheets and to speed up or slow down one pair of belts 20, while producing alignment of one sheet, will misalign all the other sheets on the conveyor. Thus the system herein contemplates the intercession of an aligning mechanism 28 (a designation used for the aligning mechanism on both sides of the stacker).

The intercession of the aligning mechanism 28 is enabled by taking the belts 20 out of operation for a portion of the veneer sheet conveyance. With reference to FIGS. 1, 3, 4, 8 and 9, the belts 20 on both sides are drawn out of the path of travel by deflecting rollers 42 (enabled by the inset of the chamber housing as will be noted by comparing FIGS. 8 and 9). The belt is repositioned back into the path by rollers 44 at a spaced distance down the path of travel. Aligning belts 46,47 are positioned respectively between the right and left hand pairs of belts 20 (as viewed along the path of travel) and assumes control over the sheets 12 during this portion of travel of the sheets 12 through the stacker. Belts 46,47 follow a path between rollers 52 and 44 (and under roller 42) located along the path of the conveyor 20. The belts 46,47 pass from rollers 52 to and around end rollers 44, then up and around drive rollers 56 and tensioning rollers 54, and back to end rollers 52. This configuration is commonly referred to as an S drive.

Drive rollers 56 are controlled by the computer. The computer receives the information from the scanners 26, calculates the amount of skew and from that, the necessary advance or retreat of belt 46 or 47. The computer accordingly instructs the drive rollers 56. When the sheet 12 is placed in the control of belts 46,47 and prior to the transfer of control to the belts 20 at rollers 44, the drive rollers 56 speed up or slow down to effect the desired alignment.

The purpose of having the alignment belts 46,47 on both sides will now be explained as, of course, it would be expected that only one of these belts would be required for the desired alignment. The reason is that there are two different sizes of sheets 12, i.e. half sheets and full sheets. If only one size sheet were being handled, only one of the belts would be required.

In that the sheets are being conveyed in rapid succession with only bare inches separating them, the length of the alignment belt (46 or 47) must be closely matched to the length of the sheet being adjusted. If two sheets are in contact with the adjusting alignment belt, both will be adjusted and one will be adjusted out of alignment. Thus for the four-foot long sheets (actually 54") belt 46 is provided as the adjusting belt and belt 47 is maintained at the speed of belts 20. The bottom reach of belt 46 on the right-hand side of the stacker is about 54" (matching the length of the full sheets).

When a full sheet is to be adjusted, the speed up or slow down of right-hand roller 56 and thus belt 46 occurs only after the sheet is fully deposited on belt 46, i.e. after the preceding sheet has been transferred to belts 20 and prior to the succeeding sheet reaching belt 46. This action is, of course, very rapid and is completed during the short interval that that sheet and only that sheet is in contact with belt 46.

It will be appreciated that belt 47 has a bottom reach length of about 27", i.e. to match the length of a half sheet. When a half sheet is to be aligned, belt 46 is maintained at the speed of belts 20 and belt 47 is adjusted by the speed up or slow down of left-hand drive roller 56 according to computer instructions. Such adjustment occurs during the period that the half sheet and only the half sheet is in contact with belt 47.

Figure 8:
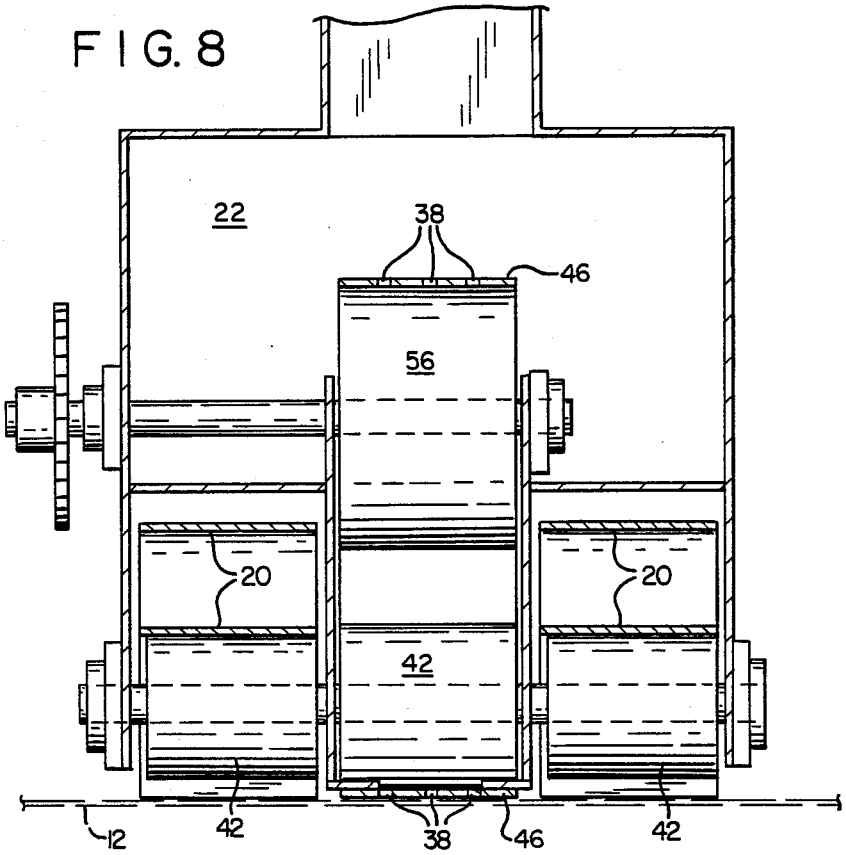
FIG. 8 is a section view as indicated by view line 8—8 of FIG. 3.
Figure 9:
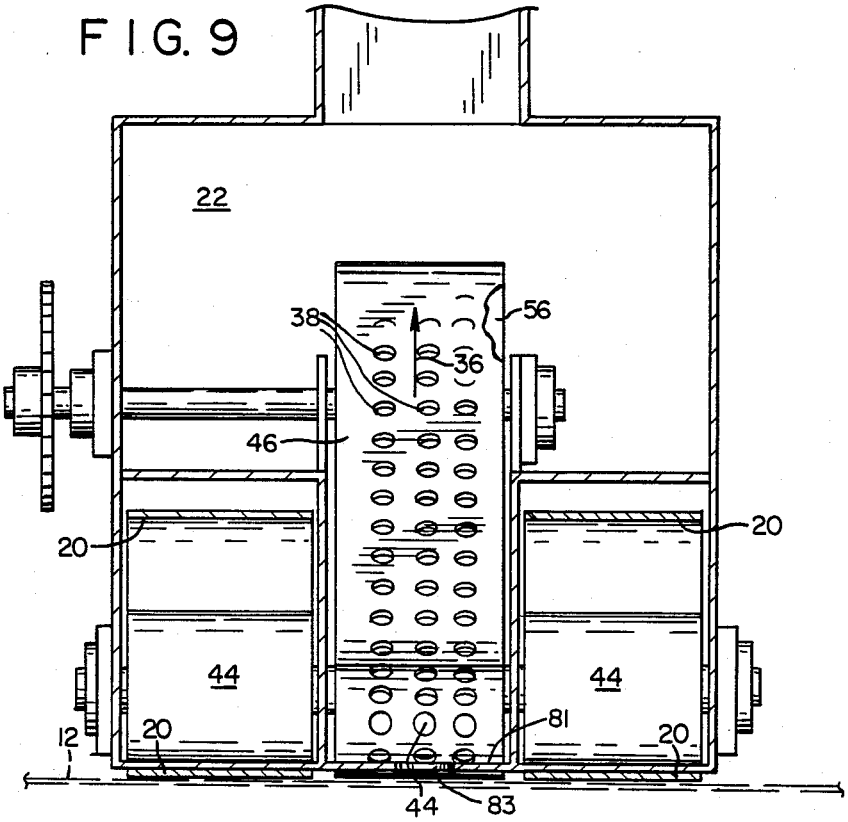
FIG. 9 is a section view as indicated by view line 9—9 of FIG. 3.

Whereas the suction for conveyor 20 is provided by air being drawn between the center gap formed between the paired belts (through holes 83 in plate 81 of the housing, as seen in FIG. 4), the aligning belts 46,47 in that portion of the pathway are placed between the paired belts and the plate 81 is removed for that portion, again as seen in FIGS. 4 and 8. Air flow through the belts 46,47 is therefore provided by perforations 38 provided through the belt.

THE KNOCK-OFF MECHANISM

Figure 5:
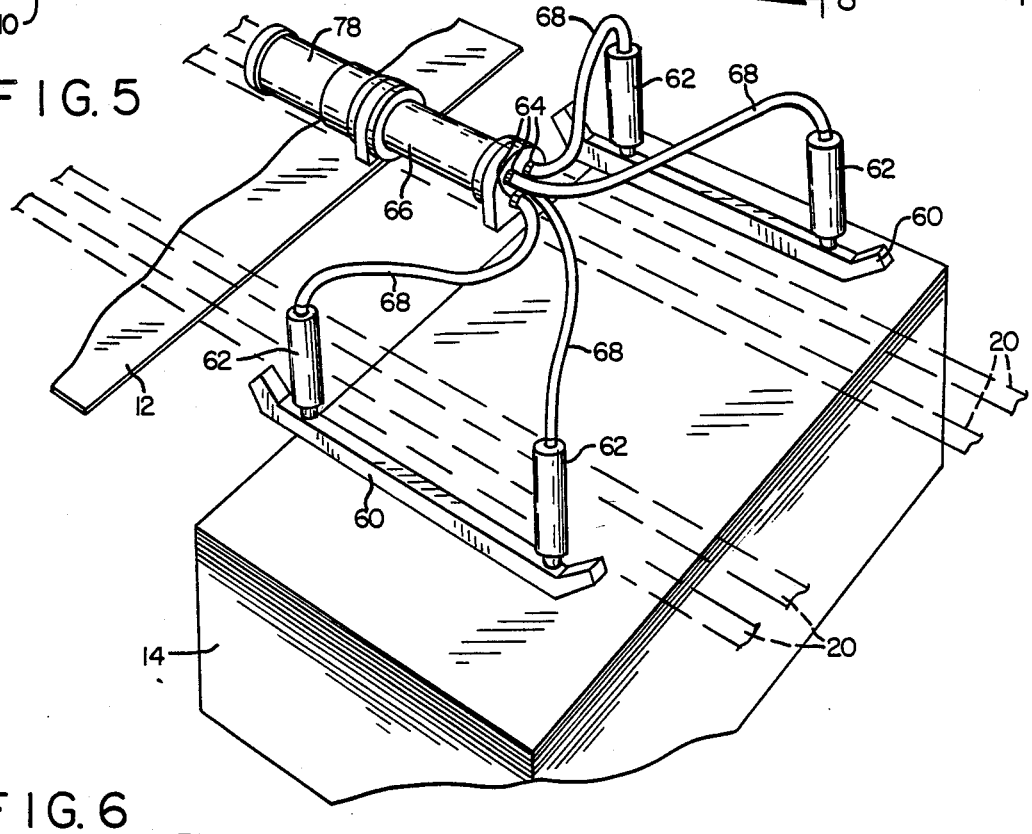
FIG. 5 is a perspective view of the veneer sheet knock-off mechanism as utilized in the system of FIGS. 1 and 2.
Figure 6:
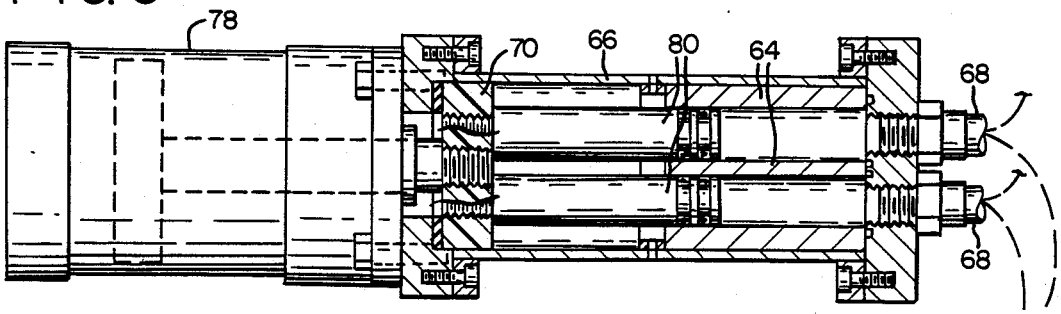
FIG. 6 is a side view of the knock-off mechanism of FIG. 5 with portions shown in section.
Figure 7:
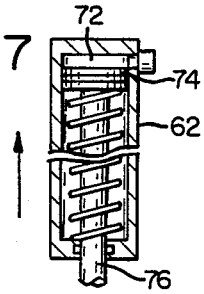
FIG. 7 is an enlarged view of one of the shoe cylinders shown in FIG. 6.
Figure 7:
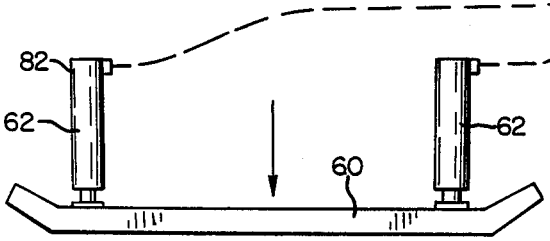

The knock-off mechanism is illustrated in FIGS. 5, 6 and 7. However, the mechanism also appears in the general layouts of FIGS. 1 and 2. The function of the knock-off mechanism is to force the veneer sheets downward off of the overhead conveyor belts 20 and to directly and positively place them onto the stacks 14. The stacks 14 are maintained at a specific spacing below the conveyor belts 20 due to the scissor support mechanism 34 (a mechanism well known to the industry). The knock-off mechanism pushes the sheets free of the belts 20 (and thus free of the influence of the air flow through the belts) and presses the sheets directly onto the stacks 14. This knock-off mechanism includes right and left hand knock-off shoes 60 spaced just outside of the pairs of belts 20 and outside air chambers 22. As indicated in FIGS. 1 and 5, the shoes 60 are each controlled by front and rear shoe cylinders 62.

It will be understood that until the shoes are activated to sever the influence of the air suction 36, the veneer sheet 12 is being drawn along the path of the belts 20. It will be further appreciated that having one side of the sheet severed from the influence of the air pressure even slightly before or after the other side, will reintroduce skewing of the sheet. If the sheet is skewed, it will not be stacked properly and the undesired damage will likely result. Thus it is imperative that the shoe cylinders 62 on the two sides of the sheet 12 are activated simultaneously so as to maintain the squared-up position. In the present case, it is desirable to activate all four shoe cylinders 62 simultaneously to accomplish this transfer of the sheets 12 from the belts 20 to the stacks 14.

The four shoe cylinders 62 are assured of simultaneous activation by coupling them to four master cylinders 64 that are simultaneously activated by a common pneumatic piston 78. The master cylinders 64 are contained in a common housing 66 and are respectively interconnected to four lines 68. Liquid movement through the four lines 68 are equally affected by simultaneous movement of the four pistons 80 in the four master cylinders 64. This simultaneous movement is ensured by the provision of a common mover piston 70 (pneumatic driven) also located in the housing 66. Activation of piston 70 (by pneumatic pressure) generates simultaneous movement of pistons 80 of the respective master cylinders 64 and corresponding simultaneous movement of pistons 74 in shoe cylinders 62. (The diameters of the respective cylinders and lines 68 being equal.) This concept of hydraulic drive for the four master cylinders 64 results in equal liquid displacement in each of the lines 68 and therefore in each of the inner chambers 72 of shoe cylinders 62. This liquid displacement generates co-equal movement of pistons 74 and piston rod 76 in cylinders 62 and thus equal movement of shoes 60 connected to piston rod 76.

Activation of piston 70 is accomplished by instructions from the computer which computes the position of each sheet. The computer knows the position of the sheet on the belt 20 from sensors 26 and the speed of the belts 20 (or by the actual travel of the belt determined by the pulse generators). The choice of stacks 14 on which the sheet 12 is to be deposited is, of course, made known to the computer from the information of the moisture detector 30 and the size of the sheet (full or half sheet). A systems designer may wish to include further sensors just prior to the entry of the sheet to each chamber rather than relying on the initial scanners 26.

OPERATION

The operation of the stacking system is believed obvious from the above description. Nevertheless, it will be briefly reviewed. A sequence of sheets 12 are moved along belt 10 into the stacking apparatus. Just prior to entry into the stacker, the sheets 12 pass the moisture detector 30. The computer then determines which of the half and full sheet stacks 14 to deposit the sheet. As the sheet leaves the detector 30 and enters the enclosure of the stacker, there is a short overlapping of the bottom supporting conveyor 10 and the overhead conveyor 20. This allows for sufficient suction force of air 36 to force adherence of the sheet to the belts 20.

As the bottom belt pulls away from the sheet, i.e. as the belt of the conveyor 10 passes around the roller 78, the scanners 26 determine the skew alignment of the sheet 12. The information of the scanners is computed by the computer and the computer accordingly conveys the appropriate instructions to one of the drive rollers 56 (depending on whether the sheet is full size or half size). The sheet is placed under the control of alignment belts 46,47 and the designated drive roller 56 either slows or speeds the belts 46,47 to generate the desired alignment.

The sheet is then passed from air chamber to air chamber until reaching the air chamber provided over the designated stack 14. When properly positioned (the position known to the computer based on the known speed or actual travel of the belt) the pneumatic driven piston 70 is activated, thereby simultaneously driving the pistons of the four master cylinders 64, and through displacement of the liquid in lines 68, driving the pistons 74 of the four cylinders 62. Both sides of the sheet are thus simultaneously released from the air suction 36 and the sheet 12 is predictably and precisely placed onto the stack 14.

The moisture content is different for different sheets even as among the common stack of sheets. (Commonly the sheets are designated as being too wet, too dry or acceptable, and each of these stacks covers a range of moisture content readings.) Some of the sheets will thus be heavier or lighter according to the moisture content. The sheets have momentum and slide on the shoes during the depositing operation. They will have different degrees of momentum due to weight differential and thus should be knocked off the conveyor belts 20 at different points on the belt. This is a matter of computer calculation and is not part of the present invention except to emphasize cooperative action as among all of the stacking functions so as to achieve the desired stacking alignment.

The features of improvement having been thus described, those skilled in the art will be able to readily incorporate the inventions of these features for the improvement of veneer sheet stacking and thereby reduce damage. Numerous variations and alternate combinations of these features will become apparent to those skilled persons and the system as described does not limit the application of the inventions. One of the variations, but by no means the only variation, would be to employ a separate belt 20 before the alignment belts 46,47 rather than pulling the long singular conveying belt system out of the pathway, i.e. by rollers 42. This is but a minor variation but is exemplary of the many changes that can be made. Accordingly, the claims appended hereto and not the above description of the preferred embodiment determines the scope of the inventions.

I claim:

1. A veneer stacking system comprising;

a veneer stacking housing separated into multiple air chambers, an air source for each air chamber for generating an independently controlled negative air pressure in each of the air chambers, a driven conveyor following a pathway across the bottom of the air chambers, the veneer stacking housing being open along said pathway and the conveyor including openings whereby air flow is generated upwardly through the conveyor, means for depositing veneer sheets in succession onto the underside of the conveyor to be attached to the conveyor by the suction of air drawn through said openings and thereby being conveyed by said belt along the pathway across the air chambers, multiple stack holders positioned below said air chambers, designating means at the outset of said pathway for analyzing the sheets in succession and for designating a stack among the plurality of stacks, for each of the sheets, and knock-off means for each stack holder for selectively dislodging the veneer sheets from the conveyor for depositing the sheets in a squared up position onto the designated stack.

2. A veneer stacking system as defined in claim 1 wherein the designating means includes a moisture detector and the stacks are designated at least in part by moisture content, and aligning means at the outset of said conveyor for aligning the sheets deposited on the conveyor to be in squared up alignment with the path of movement of the conveyor.

3. A veneer stacking system as defined in claim 2 wherein the conveyor is a pair of belt means parallel directed in spaced apart relationship along the pathway, said belt means in concert suction gripping the sides of the sheets, and said aligning means including scanning means for determining the offset of each sheet and an alignment belt that replaces a segment of one of the conveyor belt means at one side of the sheets, independent variable drive means for driving the alignment belt, said drive means being responsive to the scanning means to speed up or slow down the alignment belt and thereby said one side of the sheets for alignig the sheets relative to the path of travel.

4. A veneer stacking system as defined in claim 1 wherein the conveyor is a pair of belt means parallel directed in spaced apart relationship along the pathway, said belt means in concert suction gripping the sides of the sheets, said knock-off means including paired knock-off shoes alongside the pair of belt means, multiple pistons reciprocally moved in shoe cylinders and connected to the knock-off shoes, a master cylinder designated for each shoe cylinder, a piston in each master cylinder and a common housing for housing the plurality of master cylinders, and a common mover piston in the housing connected to the four master cylinder pistons, and actuating means to actuate the mover piston for simultaneous movement of the master cylinder pistons, said master cylinder and shoe cylinders being interconnected by liquid through lines whereby movement of the master cylinders generates equal liquid displacement and thereby simultaneous movement of the shoe cylinder pistons and corresponding simultaneous movement of the knock-off shoes.

5. A veneer stacking system comprising;

a veneer stacking housing and a veneer sheet conveyor for conveying veneer sheets along a pathway along the bottom of the housing, vacuum means for drawing air into the housing through the conveyor whereby veneer sheets are adhered to the bottom of the conveyor during the conveyance of the sheets along the pathway, and the improvement that comprises;

said conveyor including a pair of parallel directed belt means, one on each side of the sheets being conveyed, said pair of belt means traveling at the same rate of movement to maintain orientation of sheets conveyed along said pair of belt means, an alignment belt replacing a specified segment of one of said belt means and mated with a corresponding segment of the other belt means whereby a different rate of movement for the alignment belt will generate skew adjustment only of a sheet conveyed along the specified segments, separate drive means for the alignment belt, sensing means prior to the specified segments for sensing the orientation of the sheet on the conveyor relative to the desired orientation for proper stacking, and said separate drive means responsive to said sensing for selectively speeding or slowing the alignment belt and thereby skewing the sheet to the desired orientation.

6. A veneer stacking system as defined in claim 5 wherein the belt means on each side of the sheets being conveyed is a pair of spaced belts with air being drawn between the belts for adhering the sheets to the belts, and said alignment belt being positioned in the spacing between the belts of one of said pair of belts, deflection means for lifting the pair of belts away from the pathway during the portion of replacement by the alignment belt, support means for the alignment belt for supporting the alignment belt in the pathway and including a drive roller that provides the drive means therefor.

7. A veneer stacking system as defined in claim 6 wherein an alignment belt is provided at both sides of the sheet being conveyed, said stacking system adapted to selectively stack sheets of full size dimensions and half size dimensions and the difference being in the length dimension as determined by the direction of travel, one of said alignment belts matched to the length of the full sheets and the other being matched to the length of the half sheets, whereby only the matched alignment belt achieves the alignment of the sheet with the other functioning to convey the sheet in accordance with the rate of conveyance of the conveyor.

* * * * *